US010307685B2

(12) United States Patent
Sorensen

(10) Patent No.: US 10,307,685 B2
(45) Date of Patent: Jun. 4, 2019

(54) ASSEMBLY-TOY-CHASSIS BUILDING ELEMENT

(71) Applicant: Soren Christian Sorensen, San Diego, CA (US)

(72) Inventor: Soren Christian Sorensen, San Diego, CA (US)

(73) Assignee: Carol Sorensen, San Diego, CA (US)

( * ) Notice: Subject to any disclaimer, the term of this patent is extended or adjusted under 35 U.S.C. 154(b) by 8 days.

(21) Appl. No.: 15/575,195

(22) PCT Filed: May 19, 2016

(86) PCT No.: PCT/US2016/033193

§ 371 (c)(1),
(2) Date: Nov. 17, 2017

(87) PCT Pub. No.: WO2016/187381

PCT Pub. Date: Nov. 24, 2016

(65) Prior Publication Data

US 2018/0147501 A1 May 31, 2018

Related U.S. Application Data

(63) Continuation-in-part of application No. 14/716,036, filed on May 19, 2015.

(51) Int. Cl.

| | |
|---|---|
| ***A63H 17/00*** | (2006.01) |
| ***A63H 17/26*** | (2006.01) |
| ***A63H 33/08*** | (2006.01) |

(52) U.S. Cl.
CPC ..... *A63H 17/264* (2013.01); *A63H 17/002* (2013.01); *A63H 17/262* (2013.01); *A63H 33/086* (2013.01)

(58) Field of Classification Search
CPC .... A63H 17/00; A63H 17/002; A63H 17/262; A63H 17/264; A63H 19/18; A63H 33/04; A63H 33/06; A63H 33/062; A63H 33/065; A63H 33/08; A63H 33/084; A63H 33/086
See application file for complete search history.

(56) References Cited

U.S. PATENT DOCUMENTS 2,383,441 A * 8/1945 Beile ..... A63H 17/002 446/128
2,940,211 A * 6/1960 Kelley ..... A63H 33/084 446/124

(Continued)

*Primary Examiner* — Eugene L Kim
*Assistant Examiner* — Alyssa M Hylinski
(74) *Attorney, Agent, or Firm* — Edward W. Callan

(57) ABSTRACT

An assembly-toy chassis building element for a toy vehicle is configured for being non-rotatably connected to another chassis element of the toy vehicle. The chassis element has a top side, two side walls, two end walls and compatible coupling components disposed at opposite ends of the chassis element for enabling the chassis element to be rotatably coupled to another such chassis element. The top side and/or at least one end wall of each chassis element is disposed and configured for connection to an intermediate building element that is adapted, either alone or in combination with at least one other intermediate building element, to effect a non-rotatable end-to-end connection with another such chassis element.

7 Claims, 5 Drawing Sheets

(56) References Cited

U.S. PATENT DOCUMENTS

| | | | | | |
|---|---|---|---|---|---|
| 3,224,137 | A | * | 12/1965 | Wright | A63H 33/08 446/124 |
| 3,713,247 | A | * | 1/1973 | Parrilla | A63H 33/08 446/127 |
| 4,375,139 | A | * | 3/1983 | Chatani | A63H 17/26 446/471 |
| D295,642 | S | * | 5/1988 | Olsen | D21/495 |
| D370,503 | S | * | 6/1996 | Burns | D21/500 |
| D394,469 | S | * | 5/1998 | Nielsen | D21/500 |
| 5,813,894 | A | * | 9/1998 | Tohyama | A63H 17/262 446/448 |
| 6,050,044 | A | * | 4/2000 | McIntosh | A63H 33/082 446/124 |
| 7,553,209 | B1 | * | 6/2009 | Sorensen | A63H 33/06 446/124 |
| D699,792 | S | * | 2/2014 | Hwang | D21/499 |

* cited by examiner

ASSEMBLY-TOY-CHASSIS BUILDING ELEMENT

CROSS REFERENCE TO RELATED APPLICATION

This is a continuation-in-part of U.S. patent application Ser. No. 14/716,036 filed May 19, 2015.

BACKGROUND OF THE INVENTION

The invention generally pertains to building elements for assembly toys and is particularly directed to an improved chassis building element for use in assembling a toy vehicle. Assembly toys are assembled by combining various building elements of a set of compatible toy building elements, such as a set of compatible LEGO® blocks, or a set of compatible SNAPO® blocks.

An assembly-toy chassis building element may or may not be adapted to be coupled to wheels in order to assemble a toy vehicle having wheels, such as a car, a train or a trailer. Examples of other types of toy vehicles that can be assembled using a chassis building element include, but are not limited to, toy boats and toy airplanes.

SUMMARY OF THE INVENTION

The invention provides an assembly-toy building element for a toy vehicle in combination with an intermediate building element, the assembly-toy building element, comprising: a chassis element having a top side, two side walls, two end walls and compatible coupling components disposed at opposite ends of the chassis element for enabling the chassis element to be rotatably coupled to another said chassis element; wherein at least one end wall of the chassis element is disposed and configured for connection to an intermediate building element that is adapted, either alone or in combination with at least one other intermediate building element, to effect a non-rotatable end-to-end connection with another said chassis element; wherein the at least one end wall of the chassis element is configured to be non-rotatably connected to the at least one end wall of the another said chassis element by a said intermediate building element that is adapted to be non-rotatably connected to the at least one end wall of said chassis element when said intermediate building element is disposed between the chassis element and said another chassis element with the at least one end wall of the chassis element abutting an end wall of said intermediate building element; and wherein said intermediate building element is configured to cover coupled coupling components of the chassis element and the another chassis element when the intermediate element is non-rotatably connected to the at least one end wall of each chassis element.

Additional features of the invention are described with reference to the detailed description of various exemplary embodiments.

DETAILED DESCRIPTION

Figure 1:
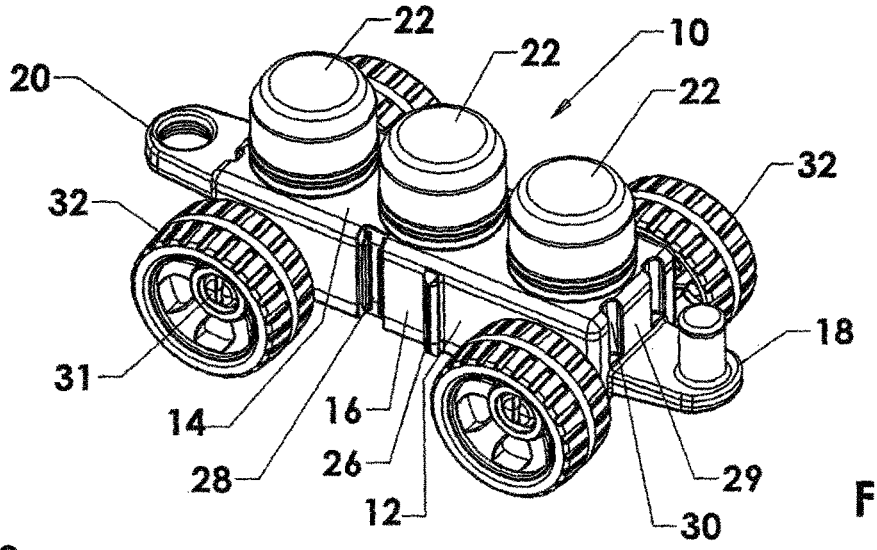
FIG. 1 is a top perspective view of one exemplary embodiment of an assembly-toy chassis building element according to the invention.
Figure 2:
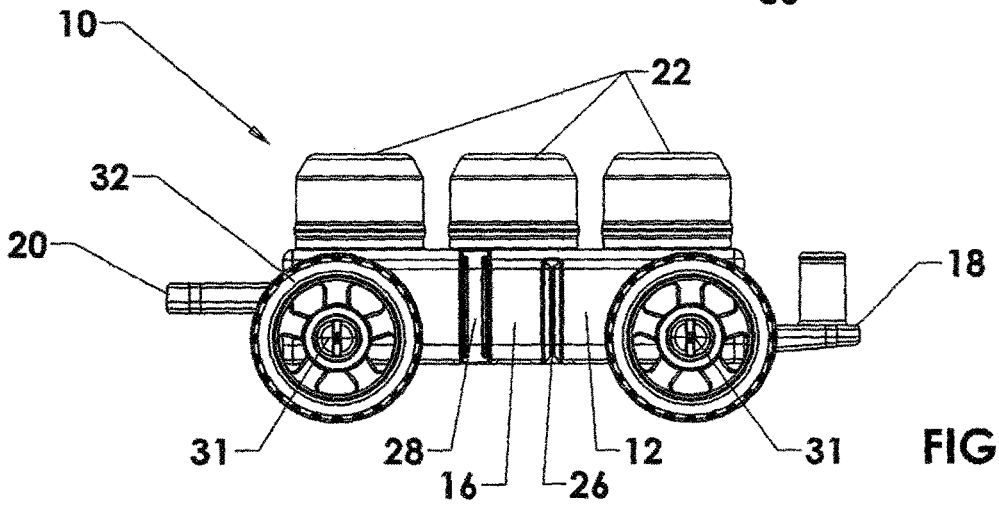
FIG. 2 is a side view of the chassis building element of FIG. 1.
Figure 3:
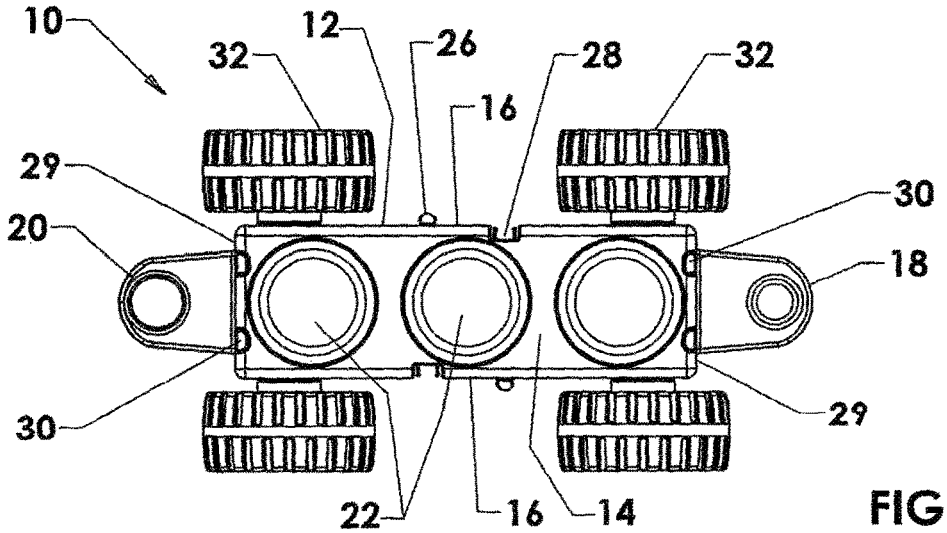
FIG. 3 is a top view of the chassis building element of FIG. 1.

Referring to FIGS. 1 through 3, an exemplary embodiment of a chassis element 12 for a toy vehicle 10 includes a top side 14, two side walls 16 on opposite sides of the chassis element 12, a first coupling component 18 disposed at one end of the chassis element 12, a second compatible coupling component 20 disposed at the opposite end of the chassis element 12, and a plurality of protrusions 22 on the top side 14 of the chassis element 12. In this exemplary embodiment the chassis element 12 is for a toy trailer. In other embodiments (not shown) the chassis element can be used for assembling other toy vehicles, such as, but not limited to, a toy airplane or a toy boat.

Figure 4:
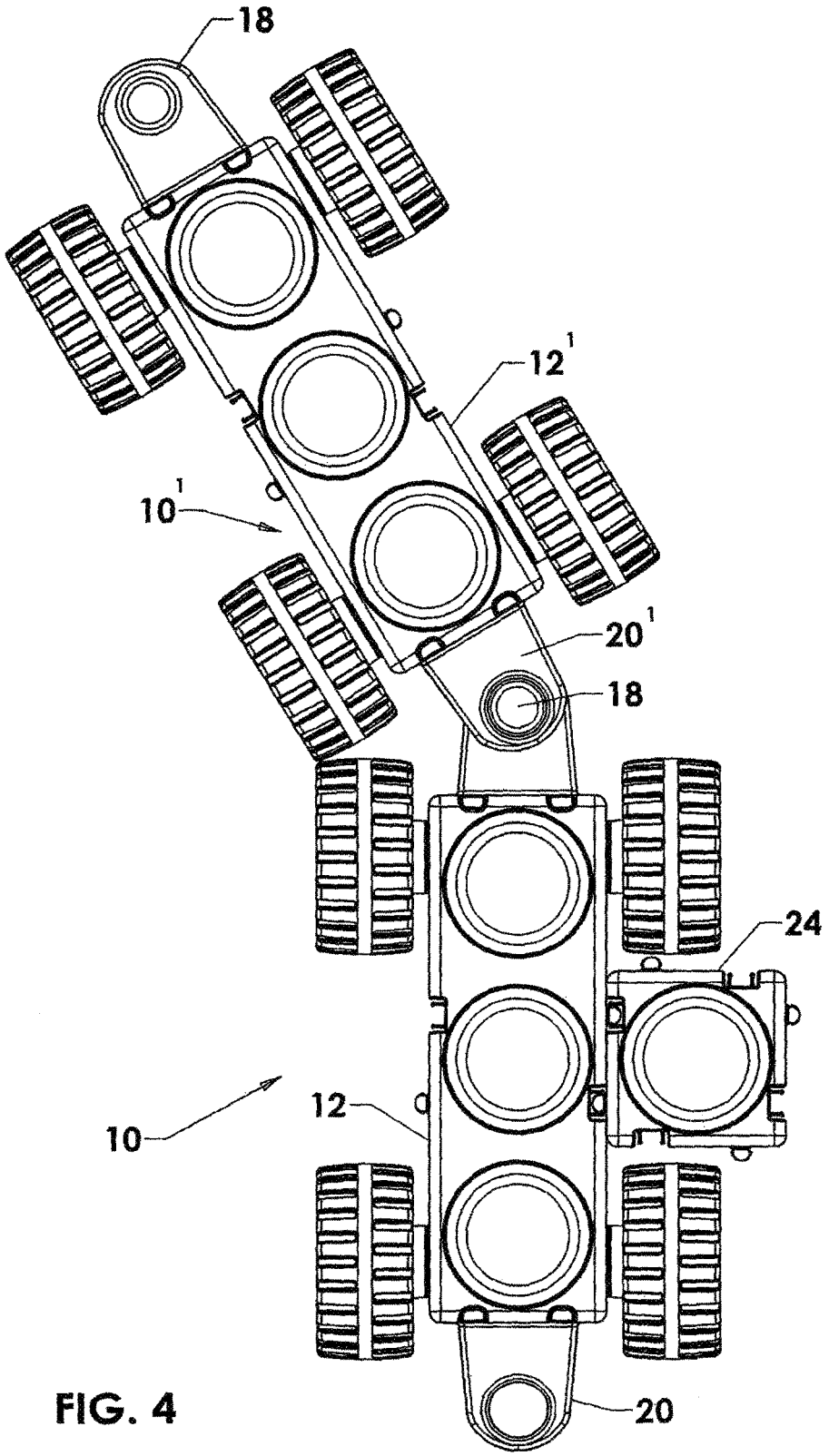
FIG. 4 is a top view of the chassis building element of FIG. 1, showing one side wall of the chassis element being interconnected with a particular wall of another building element of the toy vehicle; and also showing a coupling component at one end of the chassis element being rotatably coupled to a compatible coupling component at one end of another said chassis element.

Each side wall 16 is configured for being releasably interconnected with a particular wall of another building element 24 of the toy vehicle 10, as shown in FIG. 4. Each side wall 16 is so configured by including a tongue 26 and a compatible groove 28. The entry portion of the groove 28 has a predetermined width. In some alternative embodiments, only one side wall is so configured.

The tongue 26 has an indented portion and a distal portion, with the distal portion having a predominant width that is greater than the width of the indented portion and greater than the given predominant width of the groove entry opening for interconnecting with a groove 28 in the particular wall of the other toy building element 24 that has an entry opening and a base region that have widths like those of the groove 28 in the side wall 16 of the chassis element 12, so that the distal portion of the tongue 26 of the side wall 16 can reside in the base region of the groove in the particular wall of the other toy building element 24.

The groove 28 can be interconnected with a tongue in the particular wall of another toy building element, such as the toy building element 24, when the tongue in the particular wall of the other toy building element has a distal-portion-predominant width like the predominant width of the tongue 26 in the side wall 16 of the chassis element 12.

The other toy building element 24 can be interconnected to another building element (not shown) of the toy or be configured other than as shown in FIG. 4 to look like another building element of the toy, such as a fender of a car, a wing of an airplane, or an outrigger of a boat.

The first coupling component 18 includes a post at one end of the chassis element 12; and the compatible second coupling component 20 includes an opening in an extended portion at the other end of the chassis element 12 for receiving the post so that one end of the chassis element 12 can be rotatably coupled by a compatible coupling component to one end of a like chassis element 12', as also shown in FIG. 4.

Preferably, the compatible coupling components 18, 20 are so shaped and dimensioned that another toy building element (not shown) can be disposed over and thereby cover a coupled pair of coupling components 18, 20. In one exemplary embodiment, each of the respective end walls 29 of the chassis element 12 includes at least one groove 30 that is compatible with the tongues 26 in other building elements in a set of compatible toy building elements to enable a common square block (such as toy building element 24) to be so interconnected to the end wall 29 as to cover the coupling components 18, 20 and thereby hide them from view; which is desirable when wanting to build toy cars that do not look like trains or look like tow vehicles.

In another embodiment (not shown), the respective end walls 29 of the chassis element 12 includes both at least one tongue and at least one groove that is compatible with the tongues 26 and 28 in other building elements in a set of compatible toy building elements.

The protrusions 22 on the top side 14 of the chassis element 12 are configured for being releasably interconnected with one or more other building elements of the toy vehicle. Such other building elements of the toy vehicle are interconnected with the chassis element 12 by being stacked or snapped onto the protrusions 22. Preferably, the protrusions 22 are wide and have a tapered top portion to facilitate assembly of the other building elements onto the protrusions 22. In some embodiments, the protrusions 22 are integral to the top side 14 of the chassis element 12. When the chassis element 12 is made by injection molding, the protrusions 22 are formed simultaneously in the same mold as the basic chassis element 12. In some alternative embodiments (not shown), there are no protrusions on the top side of the chassis element.

In some embodiments, the chassis element 12 includes at least one axle 31 that is adapted for being coupled to wheels 32.

Figure 5:
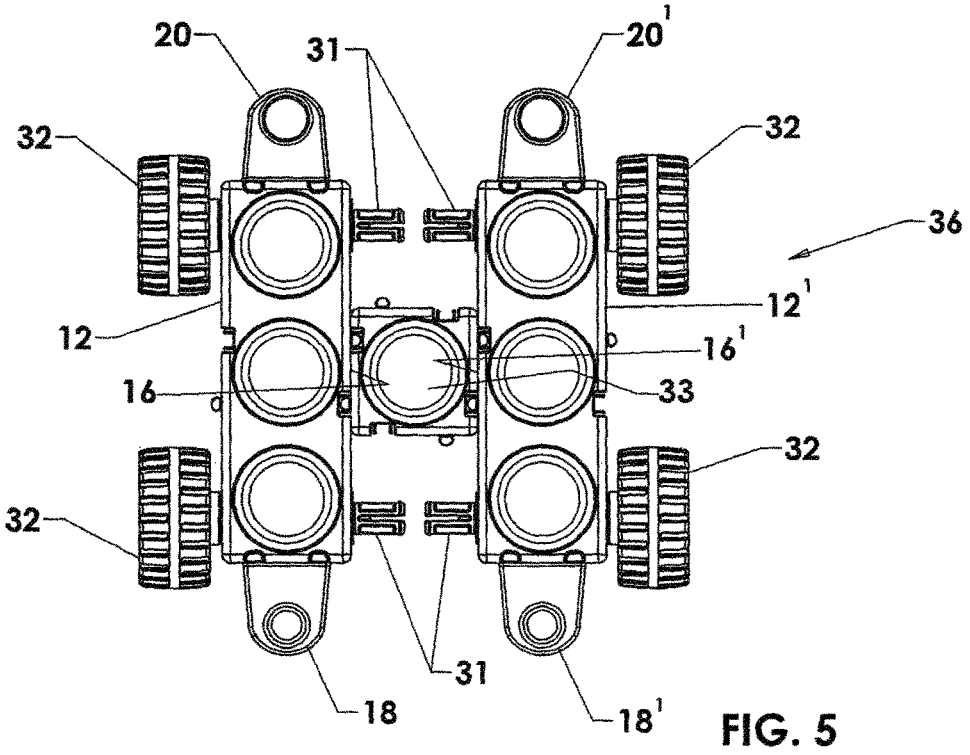
FIG. 5 is a top view of the toy vehicle chassis element of FIG. 1, showing one side wall of the chassis element being interconnected with one side wall of another said chassis element.

In order to assemble a wider assembly-toy vehicle-chassis element 36, one side wall 16 of the chassis element 12 is interconnected by an intermediate building element 33 with one side wall 16' of another chassis element 12', as shown in FIG. 5. Particular side walls of the intermediate building element 33 include tongues and grooves (not shown) that are compatible with the tongues 26 and grooves 28 in the side walls 16, 16' of the chassis elements 12, 12'.

For assembling a wider toy vehicle 36 in accordance with the embodiment shown in FIG. 5, the axles 31 protrude from the sides of the chassis building elements 12, 12' by less than one-half the width of the intermediate toy building element 33 that is adapted for coupling one side of the chassis element 12 to a side wall 16' of another chassis element 12' so that when wheels 32 are not engaged by the axles 31 on the sides of the respective chassis elements 12, 12' that are to be interconnected, the one side wall 16 of the chassis element 12 can be connected to the side wall 16' of the other chassis element 12' by the intermediate building element 33, to thereby assemble a wider toy vehicle.

Figure 6:
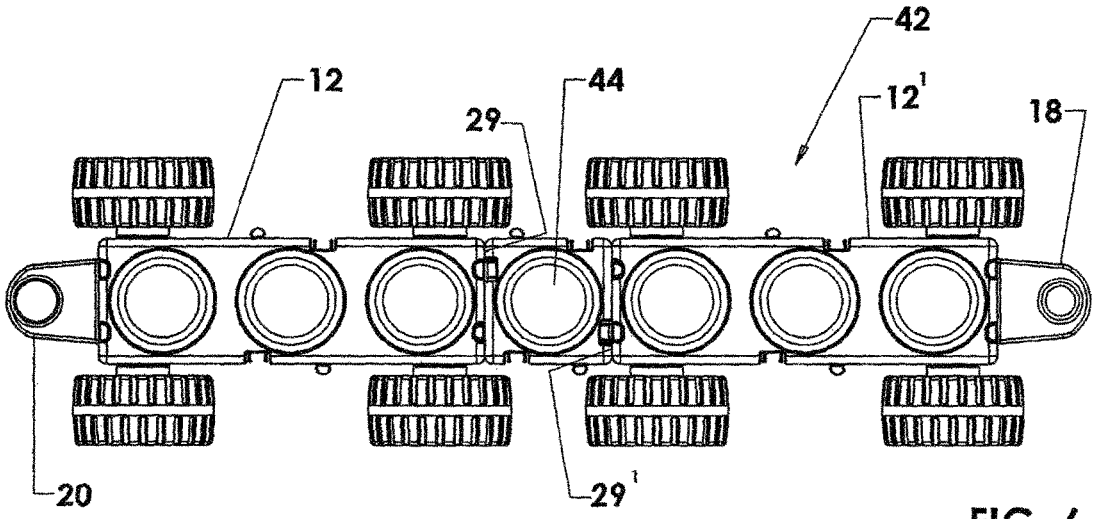
FIG. 6 is a top view of the toy vehicle chassis element of FIG. 1, showing one end of the chassis element being interconnected with one end of another said chassis element.

Referring to FIG. 6, in order to assemble a longer toy vehicle 42, one end wall 29 of one chassis element 12 is non-rotatably connected to the end wall 29' of another chassis element 12 by an intermediate building element 44, which has tongues (not shown) in its end walls that are compatible with the grooves 30 in the end walls 29, 29' of the two chassis elements 12, 12', and by sliding the intermediate building element 44 downward in the grooves 30 in order to cover a coupled pair of compatible coupling components 18, 20' of the respective chassis building elements 12, 12'.

In another alternative embodiment (not shown), the features shown in and described with reference to FIGS. 5 and 6 can be combined to assemble a toy vehicle that is both wider and longer than the toy vehicle shown in FIGS. 1-3.

The chassis element 12 described above with reference to FIGS. 1 to 6 can be used to assemble a toy car, a toy train or a toy trailer.

Figure 7:
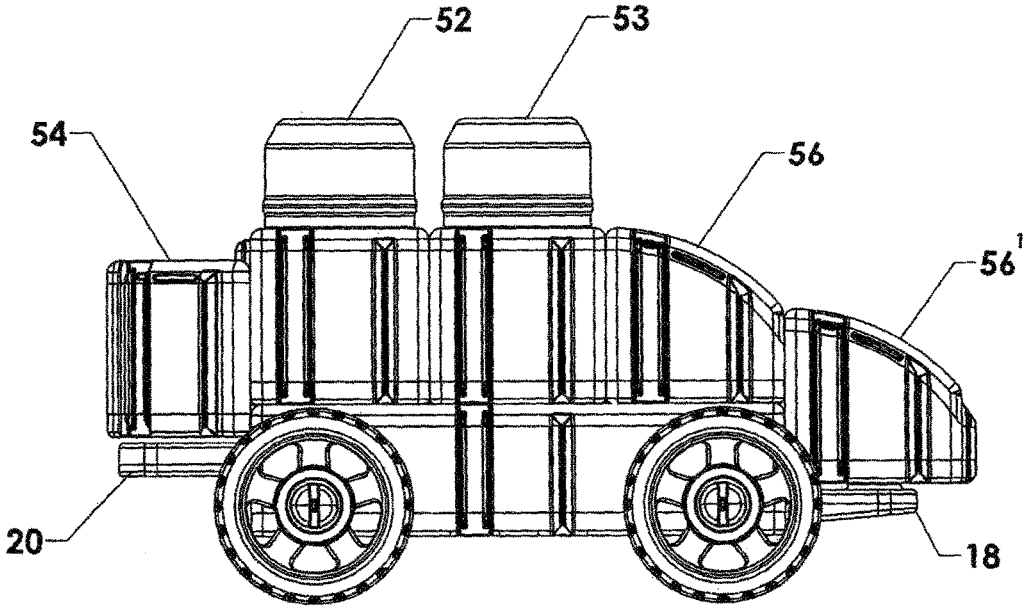
FIG. 7 is side view of an exemplary toy car assembled by interconnecting the vehicle-chassis building element of FIG. 1 with compatible building elements.
Figure 8:
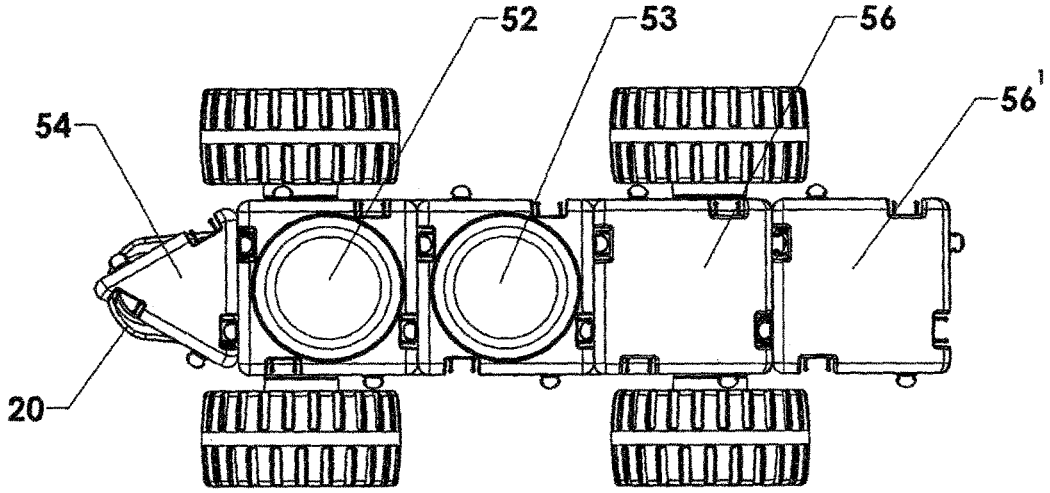
FIG. 8 is top view of an exemplary toy car of FIG. 7.

FIGS. 7 and 8 show an exemplary toy car 50 that is assembled by interconnecting the chassis element 12 with compatible building elements 52, 53, 54, 56, 56'. The side walls and the end walls of the building elements 52, 53, 54, 56, 56' include tongues and grooves that are compatible with the tongues 26 and grooves 28 in the side walls 16 of the chassis element 12. The bottoms of the building elements 52, 53, 54, 56, 56' are open so that they can be disposed onto the protrusions 22 of the chassis element 12.

Facing end walls of the building elements 52, 53, which have an approximately square lateral shape, are interconnected tongue-in-groove and disposed onto protrusions 22 of the chassis element 12, with the building element 52 being disposed on one end protrusions of the chassis element 12.

One end wall of the building element 54 is interconnected tongue-in-groove to the exposed end wall of the building element 52 and disposed to cover one coupling component 20 of the chassis element 12 by sliding the building element 54 downward within both a groove in the exposed end wall of the building element 52 and an aligned groove 30 in the end wall 29 of the chassis element 12. The approximately triangular lateral shape of the building element 54 provides a pointed feature at one end of the toy vehicle 50. For other toy vehicles, the building element has another lateral shape.

The higher end wall of one building element 56, which has a sloped-roof shape, is interconnected tongue-in-groove to the exposed end wall of the building element 53 and disposed onto the other end protrusion 22 of the chassis element 12.

The higher end wall of the building element 56', which also has a sloped-roof shape, is interconnected tongue-in-groove with the lower end wall in the aforementioned building element 56 having a sloped-roof shape, and disposed to cover the post of the coupling component 18 of the chassis element 12 by sliding the other building element 56' downward within a groove in the lower end wall of the one sloped-roof building element 56 having a sloped-roof shape. The sloped-roof shape of the building elements 56, 56' provides a sloped-roof feature at one end of the toy vehicle 50. For other toy vehicles, the building elements 56, 56' have other shapes.

Figure 9:
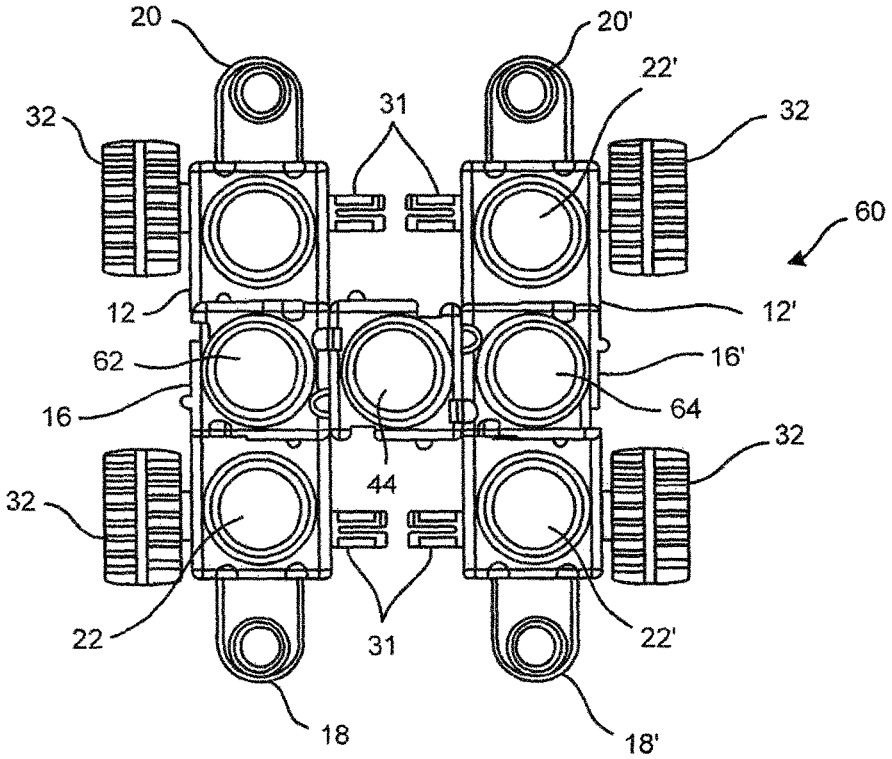
FIG. 9 illustrates a side-side connection of two chassis elements that is alternative to the side-to side connection of two chassis elements shown in FIG. 5.

Referring to FIG. 9, an alternative exemplary embodiment of a wider toy vehicle 60 is assembled by utilizing the protrusions 22, 22' on the top side of two chassis elements 12, 12' to effect a side-to-side confection of the two chassis elements 12, 12'. A protrusion 22 on the top side of one chassis element 12 is configured for being interconnected beneath an intermediate building element 62 that is adapted to be connected to another intermediate building element 44 that is connected to still another intermediate building element 64 that is interconnected on top of a protrusion 22' on the top side of the other chassis element 12', to thereby effect the side-to-side connection of the two chassis elements 12, 12'. In this alternative exemplary embodiment, the tongue and groove connectors on the side walls of the chassis elements, as shown in FIG. 3, are not utilized, and can be omitted from the chassis elements, if desired.

Figure 10:
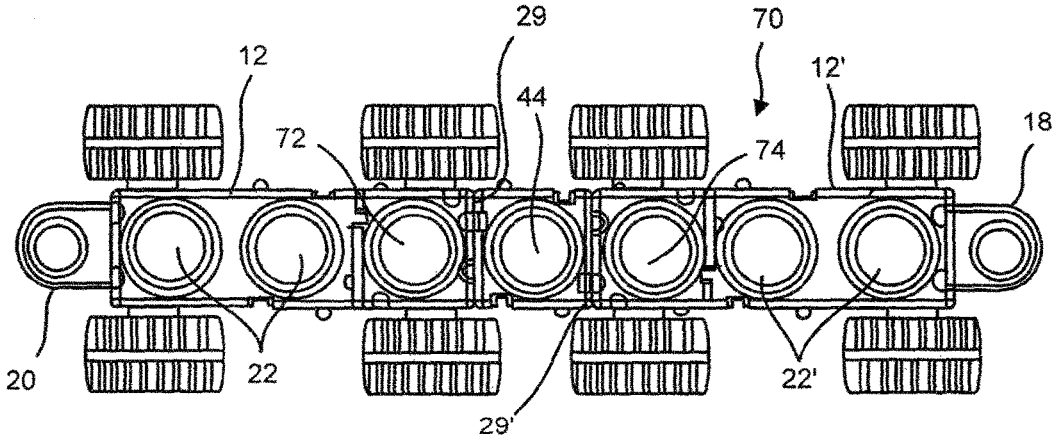
FIG. 10 illustrates a non-rotatable end-to-end connection of two chassis elements that is alternative to the non-rotatable end-to-end connection of two chassis elements shown in FIG. 6.

Referring to FIG. 10, an alternative exemplary embodiment of a longer toy vehicle 70 is assembled by utilizing the protrusions 22, 22' on the top side of two chassis elements 12, 12' to effect a non-rotatable end-to-end connection of the two chassis elements 12, 12'. An end protrusion on the top side of one chassis element 12 is configured for being interconnected beneath an intermediate building element 72 that is adapted to be non-rotatably connected to another intermediate building element 44 that is non-rotatably connected to still another intermediate building element 74 that is interconnected on top of an end protrusion on the top side of the other chassis element 12', to thereby effect the non-rotatable end-to-end connection of the two chassis elements 12, 12'. In this alternative exemplary embodiment, the tongue and groove connectors on the end walls of the chassis elements, as shown in FIG. 3, are not utilized, and can be omitted from the chassis elements, if desired.

In another alternative embodiment (not shown), the features shown in and described with reference to FIGS. 9 and 10 can be combined to assemble a toy vehicle that is both wider and longer than the toy vehicle shown in FIGS. 1-3.

The benefits specifically stated herein do not necessarily apply to every conceivable embodiment of the invention. Further, such stated benefits of the invention are only examples and should not be construed as the only benefits of the invention.

While the above description contains many specificities, these specificities are not to be construed as limitations on the scope of the invention, but rather as examples of the preferred embodiments described herein. Other variations are possible and the scope of the invention should be determined not by the embodiments described herein but rather by the claims and their legal equivalents. The claims require no implicit limitations. Each claim is to be construed explicitly as stated, or by its legal equivalent.

The invention claimed is:

1. An assembly-toy building element for a toy vehicle in combination with an intermediate building element, the assembly-toy building element comprising:

a chassis element having a top side, two side walls, two end walls and compatible coupling components disposed at opposite ends of the chassis element for enabling the chassis element to be rotatably coupled to another said chassis element;

wherein at least one end wall of the chassis element is disposed and configured for connection to the intermediate building element that is adapted, either alone or in combination with at least one other intermediate building element, to effect a non-rotatable end-to-end connection with another said chassis element;

wherein the at least one end wall of the chassis element is configured to be non-rotatably connected to the at least one end wall of the another said chassis element by a said intermediate building element that is adapted to be non-rotatably connected to the at least one end wall of said chassis element when said intermediate building element is disposed between the chassis element and said another chassis element with the at least one end wall of the chassis element abutting an end wall of said intermediate building element; and wherein said intermediate building element is configured to cover coupled coupling components of the chassis element and the another chassis element when the intermediate element is non-rotatably connected to the at least one end wall of each chassis element.

2. The assembly-toy building element according to claim 1, wherein at least one side wall of the chassis element is configured for connection to an intermediate building element that is adapted, either alone or in combination with at least one other intermediate building element, to effect a side-to-side connection with another said chassis element.

3. The assembly-toy building element according to claim 1, wherein the top side of the chassis element includes at least one protrusion that is configured for being interconnected with an intermediate building element that is adapted to be connected to another said intermediate building element that is connected to still another said intermediate building element that is interconnected to a said protrusion on the top side of another said chassis element to thereby effect a side-to-side connection with the another said chassis element.

4. The assembly-toy building element according to claim 1, wherein each side wall of the chassis building element further includes at least one axle that is adapted for being coupled to wheels.

5. The assembly-toy building element according to claim 4, wherein at least one axle protrudes from said at least one side wall of the chassis element by less than one-half the width of a said intermediate building element that is adapted for coupling said at least one side of the chassis element to a side of another chassis element so when wheels are not engaged by the axles on the sides of the respective chassis elements that are to be coupled, the one side of the chassis element can be coupled to said side of said other chassis element by the said intermediate building element, to thereby assemble a wider toy vehicle.

6. The assembly-toy building element according to claim 1, wherein the coupling components are so shaped and dimensioned that another toy building element can be disposed over and thereby cover a coupled pair of said coupling components.

7. The assembly-toy building element according to claim 1, wherein the at least one end wall of the chassis element includes at least one groove that is compatible with tongues in other building elements in a set of compatible toy building elements so that a toy building element that is dimensioned to cover coupled said coupling components can be interconnected to the at least one end wall and disposed to cover the coupled coupling components.

* * * * *